US005862772A

United States Patent [19]

Yancey et al.

[11] Patent Number: 5,862,772

[45] Date of Patent: Jan. 26, 1999

[54] DAMAGE CONTROL MATERIALS FOR WARSHIP CONSTRUCTION

[75] Inventors: William A. Yancey, Farmville; Ted M. Daves, Dillwyn, both of Va.; Ronald F. Swann, Oxon Hill, Md.; Noel J. Tessier, North Attleboro; James M. Teague, Norfolk, both of Mass.

[73] Assignee: Emerson & CumingComposite Materials, Inc., Canton, Mass.

[21] Appl. No.: 772,547

[22] Filed: Dec. 26, 1996

[51] Int. Cl.[6] ..... B63B 5/24

[52] U.S. Cl. ..... 114/357; 114/1; 114/74 A

[58] Field of Search ..... 114/74 A, 65 R, 114/68, 69, 357, 343, 1, 9–13; 441/1

[56] References Cited

U.S. PATENT DOCUMENTS

| | | | |
|---|---|---|---|
| 4,474,129 | 10/1984 | Watkins et al. | 114/243 |
| 5,218,919 | 6/1993 | Krulikowski, III et al. | 114/74 A |
| 5,613,460 | 3/1997 | Stallard, III | 114/347 |

*Primary Examiner*—Ed Swinehart
*Attorney, Agent, or Firm*—Paul J. Cook

[57] ABSTRACT

A warship is provided with a plurality of interior volumes defined by an inner wall structure and an outer wall structure spaced apart from the inner wall structure. The space between the inner wall structure and the outer wall structure includes a syntactic foam-macrosphere composition between the wall structure which dissipates force applied to an outer wall structure.

17 Claims, 8 Drawing Sheets

DAMAGE CONTROL MATERIALS FOR WARSHIP CONSTRUCTION

BACKGROUND OF THE INVENTION

1. Field of the Invention

The present invention relates to damage control materials for warship construction and, more particularly, to a warship construction including an energy absorbing composition positioned to surround and protect areas of the ship that house critical elements and personnel required to accomplish the ship's mission. More particularly, the present invention relates to such a warship wherein the energy absorbing composition includes hollow microspheres and hollow macrospheres in a resin matrix.

2. Description of Prior Art

Warships are constructed from metal plates designed to withstand impact explosion and shock forces of weapons which are designed to damage or sink the ship. While the plates and the supporting structure for the plates, such as web frames or girders, improve the defense strength of the ship, limitations on their size are imposed, primarily due to considerations of ship buoyancy, ship stability and ease of ship handling during passage on the sea. Ships are formed of hulls having a variety of configurations. Some ships have double bottoms and double sides to form an inner hull and an outer hull, traditionally termed a double hull construction. In large ships, the space between the two hulls typically is at least about two meters. The volume defined by the inner surface of the inner hull comprises the volume within which the ships personnel are housed and within which weapons and supplies, including munitions are stored. The double hull design conventionally is orthogonally-stiffened by both transverse web frames and longitudinal girder (or longitudinal "webs") between the inner and outer hulls to form a stiff grid bottom structure beneath the main volume of the ship. While it is known that double hulls can effectively protect against minor impact forces, it is also known that they are ineffective to withstand strong impact forces such as that derived from weapons effects directed at the ship. Such strong impact forces cause both the inner and outer hulls to be breached. Areas of the warship, in addition to the hull, also must be protected against impact forces from incoming projectiles directed at the ship during times of war. Additional protection in specific areas of the ship may be required for the isolation of damage due to weapons effects or other extremely high energy releasing events. These areas include housing of personnel, munitions, offensive weapons and the ship's communication system.

It has been proposed to provide strength enhancing and shock absorbing elements between the two hulls of double hull ship. It also has been proposed to provide a foam material between the two hull to provide improved hull strength. Such arrangements are shown, for example in U.S. Pat. Nos. 3,811,141; 3,831,212; 3,840,296; 3,887,952 and 3,911,190. It has also been proposed to utilized hollow beads between the two hulls, as for example by U.S. Pat. No. 3,124,626. While the use of foam material or hollow beads comprise an improvement over a hollow space between the two hulls to effect absorbance and diffusion of force applied to the outer hull and to reduce force transmission to the inner hull, their use is undesirable since a significant portion of the impact force is transmitted to the inner hull.

It has also been proposed in U.S. Pat. No. 5,353,727 to provide a collision guard to the exterior hull surface of a marine vessel which is formed from a lightweight permanent buoyant material, such as a fire retardant foam, in order to improve resistance against forces applied to the exterior hull. Such modules are undesirable since they are subjected to the normal sea forces to which a vessel is subjected resulting in their detachment from the vessel.

It has been proposed in U.S. Pat. No. 5,277,145 to increase the strength of a transom portion of a boat with syntactic foam formed from a resin containing hollow microspheres, usually made of glass. These microspheres generally have a diameter of between about 1 and about 100 microns. Such syntactic foam compositions are undesirable for use between hulls of double hull since they preferentially transmit rather than absorb forces applied to them. This is primarily due to the fact that the microspheres, when embedded within a thermosetting resin, are extremely resistant to impact forces and thus transmit impact force through the composition rather than collapsing up to the point wherein very high impact forces are applied to the syntactic foams.

Modified syntactic foam are disclosed in U.S. Pat. No. 3,622,437 for use as buoyant materials to be positioned in sea environments, for example more than a thousand feet below the surface of the sea. Such modified syntactic foams include relatively large hollow spheres which provide a reduced density for the modified syntactic foam as compared to the unmodified syntactic foam.

Accordingly, it would be desirable to provide a warship construction which includes an energy absorbing composition positioned in those areas of the warship requiring protection. In addition, it would be desirable to provide such a composition which does not significantly adversely effect the buoyancy of the vessel when the composition is positioned within the warship. Furthermore, it would be desirable to provide such a composition which preferentially absorbs energy when excessive energy is applied to it rather than transmitting energy to the ship's structural elements so that critical areas of the ship remain protected.

SUMMARY OF THE INVENTION

Figure 1:
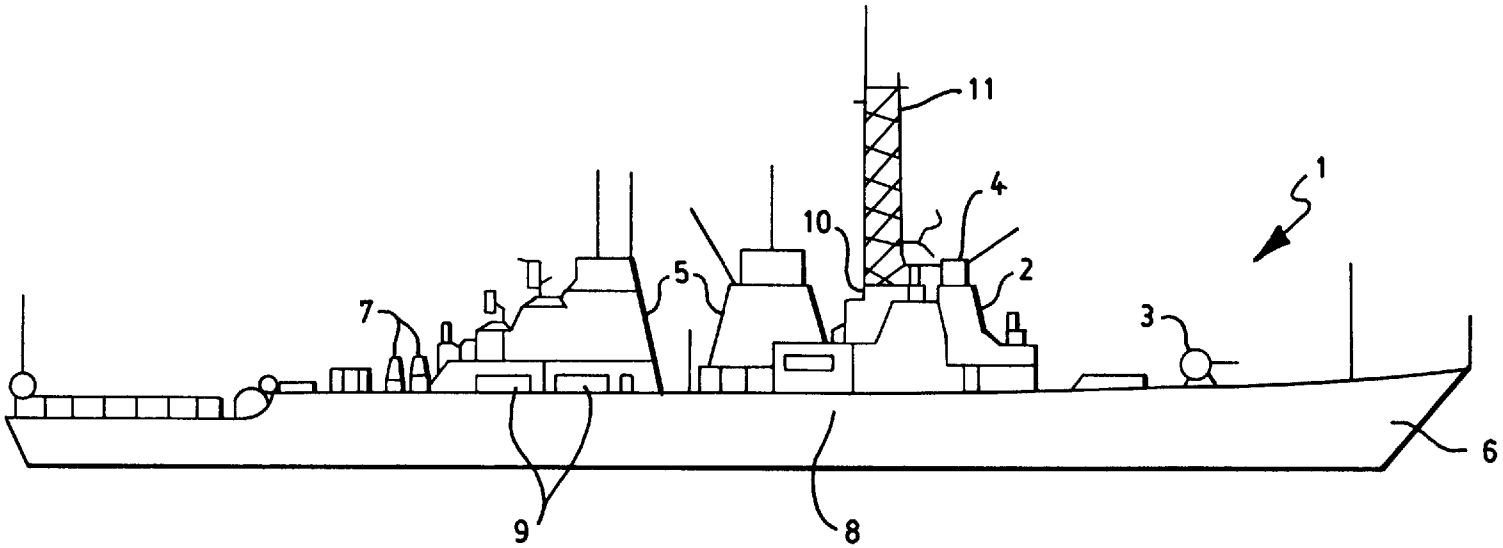
FIG. 1 is a side view of a warship vessel utilizing the construction of this invention.

In accordance with the present invention, a construction for a warship is provided which includes a force-absorbing composition positioned within the ship in areas that require protection from impact forces including impact force generated by incoming projectiles. The force-absorbing composition is a syntactic foam comprising a resin matrix and hollow microspheres and which includes hollow macrospheres. As used herein the term, "syntactic foam" means a hardened or hardenable resin matrix containing small hollow microspheres, such as glass microspheres or polymeric, e.g., polypropylene or polyurethane, microspheres having a diameter between about 1 and about 100 microns as defined by the ASTM Committee on Syntactic Foam. As used herein, the term, "macrospheres", means hollow spheres formed from a resin binder either alone or containing reenforcing fibers such as glass fibers, carbon fibers or the like having a diameter about 1/16 inch and 4 inches. The volume percent hardened syntactic foam to macrospheres is between about 10 to 60 volume % syntactic foam to about 40 to 90 volume % macrospheres, preferably between about 20 to 40 volume % syntactic foam to about 60 to 80 volume % macrospheres, The syntactic foam functions to provide strength and energy absorbing properties to the composition positioned between the two hulls. The macrospheres function to provide light weight, strength and energy absorbance capacity to the composition.

The syntactic foam-macrosphere composition is positioned in spaces surrounding that portion of the ship containing materials or personnel to be protected by first introducing the macrospheres into the spaces. Thereafter, the syntactic foam, while the resin matrix is in a fluid state, is introduced into the spaces such as by being pumped. The macrospheres can have varying diameters or can have essentially the same diameter. After the syntactic composition has been pumped into the spaces, the resin portion thereof is allowed to harden by being thermally cured at a suitable temperature to effect crosslinking of the resin matrix and to render it thermosetting. Alternatively, projectiles. The force-absorbing composition is a syntactic foam comprising a resin matrix and hollow microspheres and which includes hollow macrospheres. As used herein the term, "syntactic foam" means a hardened or hardenable resin matrix containing small hollow microspheres, such as glass microspheres or polymeric, e.g., polypropylene or polyurethane, microspheres having a diameter between about 1 and about 100 microns as defined by the ASTM Committee on Syntactic Foam. As used herein, the term, "macrospheres", means hollow spheres formed from a resin binder either alone or containing reenforcing fibers such as glass fibers, carbon fibers or the like having a diameter about 1/16 inch and 4 inches. The volume percent hardened syntactic foam to macrospheres is between about 10 to 60 volume % syntactic foam to about 40 to 90 volume % macrospheres, preferably between about 20 to 40 volume % syntactic foam to about 60 to 80 volume % macrospheres, The syntactic foam functions to provide strength and energy absorbing properties to the composition positioned between the two hulls. The macrospheres function to provide light weight, strength and energy absorbance capacity to the composition.

The syntactic foam-macrosphere composition is positioned in spaces surrounding that portion of the ship containing materials or personnel to be protected by first introducing the macrospheres into the spaces. Thereafter, the syntactic foam, while the resin matrix is in a fluid state, is introduced into the spaces such as by being pumped. The macrospheres can have varying diameters or can have essentially the same diameter. After the syntactic composition has been pumped into the spaces, the resin portion thereof is allowed to harden by being thermally cured at a suitable temperature to effect crosslinking of the resin matrix and to render it thermosetting. Alternatively, the macrosphere syntactic foam can be molded off site and mechanically installed on the ship.

When the ship is subjected to an impact force initiated on an outside surface or an internally generated high energy, extreme loading event, the force is transmitted from the outside surface into the composition and, if the impact force is sufficiently high, the macrospheres in close proximity to the point of impact begin to fracture under the force of the impact thereby absorbing the impact force. When the impact force is sufficiently high, the macrospheres fracture sequentially; first at the most proximate points to the point of initial impact and thereafter sequentially fracturing progressively away from the point of initial impact. Due to macrosphere fracturing, the impact force is dissipated significantly prior to its being transmitted, by way of the hardened resin matrix of the syntactic foam, to the inner portion of the ship.. By substantially reducing the impact force prior to the force reaching the inner portion of the ship, the probability of significant ship damage is correspondingly reduced or eliminated. Accordingly, the syntactic foam-macrosphere composition utilized in the present invention provides substantial advantages over a hardened syntactic foam or an empty space.

DESCRIPTION OF SPECIFIC EMBODIMENTS

The terms, "wall structure" as used in herein is meant to include a curved or flat barrier such as a wall, bulkhead or hull which alone, or together with at least one other wall, bulkhead or hull defines an interior volume positioned within said "wall structure". Such interior volumes can be used for any conventional warship purpose, such as housing for personnel, storage of ammunition, storage of communication systems, storage of weapons, storage of projectile delivery systems, missile silos or the like.

In accordance with the present invention the spaces within a warship such as the space between an inner hull and an outer hull of a double hull construction are filled with a composition comprising a hardened syntactic foam and macrospheres. The volume ratio of hardened syntactic foam to macrospheres is between about 10 and about 60 volume % syntactic foam, preferably between about 20 and 40 volume % syntactic foam and between about 40 and about 90 volume % macrospheres, preferably between about 60 and about 80 volume % macrospheres. The macrospheres can have an essentially uniform diameter or can have a varying diameter between about 1/16 inch and about 4 inches, preferably between about 1/4 inch and about 1/2 inch. The macrospheres can be formed from thermoset or thermoplastic polymer such as of any synthetic resin composition which may include a reinforcing agent such as fibers including glass fibers, carbon fibers or the like. The macrospheres typically are formed of polyvinyl esters, polyesters, phenolic resins, epoxy resins, polyurethanes, polyamides, high density polyethelynes, polypropylenes, polyacrylonitriles, acrylonitrile butadiene styrene, or styrene acrylonitrile. The macrospheres typically are formed by conventional injecting molding such as molding two matched hemispheres and joining them or rotational molding or the like.

The syntactic foam contains glass microspheres having a diameter between about 1 and 300 microns, preferably wherein 50% of the microspheres have a diameter between about 30 and about 70 microns. The resin carrier for the syntactic foam initially is a pumpable liquid which is curable over time at room temperature or at elevated temperature. Exemplary resin matricies include phenolic resins, epoxy resins, polyurethanes, polyesters, polyureas, polyvinyl esters, polyamides, or the like. The resin is curable to form a crosslinked thermoset hardened composition which is not flowable at ambient temperature. If desired, the resin can contain conventional resin modifiers including stiffening modifiers such as rubber modifiers including butane based rubbers or fibers such as glass fibers or carbon fibers or the like.

Typically, the space between the inner and outer hull of a double hull vessel is segmented so that sub volumes thereof are defined by plate members which are positioned generally orthogonally within the volume. Segmentation of this volume provides strength to the double hull structure. When segmented volumes are provided within the space between the two hulls, orifices are provided through the walls of each segment to permit fluid communication into the segment volume from outside the segment volume. These volumes are filled with the syntactic foam-macrosphere composition by introducing the macrosphere composition into the volume through the orifice to fill the volume to the desired degree. Thereafter, the flowable syntactic foam composition is pumped into the volume to fill the remainder of the volume with the syntactic foam. A second orifice is provided to permit air in the volume to flow through the volume thereby to permit displacement thereof with the syntactic foam. The syntactic foam then is cured in place to form a thermoset composition either by effecting curing at ambient temperature or at elevated temperature, depending upon the cure resin utilized. Suitable curing temperatures are well known to a person skilled in the art. Liquid flow into the segment volumes is prevented by the cured resin. If desired, the orifices can be further sealed such as with metal plates.

Referring to FIG. 1 a warship 1 includes a bridge section 2 for personnel to control the ship, gun turrets 3 and 4 stacks 5, a double hull 6, weapons storage areas 7, 8 and 9 and communications sections 10 having an antenna 11. The interior volume within hull 6 is segmented by walls, bulkheads or the like to isolate personnel living areas from work areas and weapons storage areas or the like. In one aspect of this invention the warship can be arranged to be remotely controlled so that no on-board personnel are needed. The walls or bulkhead can include orifices to permit personnel access to various areas of the ship. At least a portion of the walls or bulkheads are constructed as double walls or double bulkheads spaced apart from each other to form a space within which the energy absorbing composition can be positioned.

Figure 2:
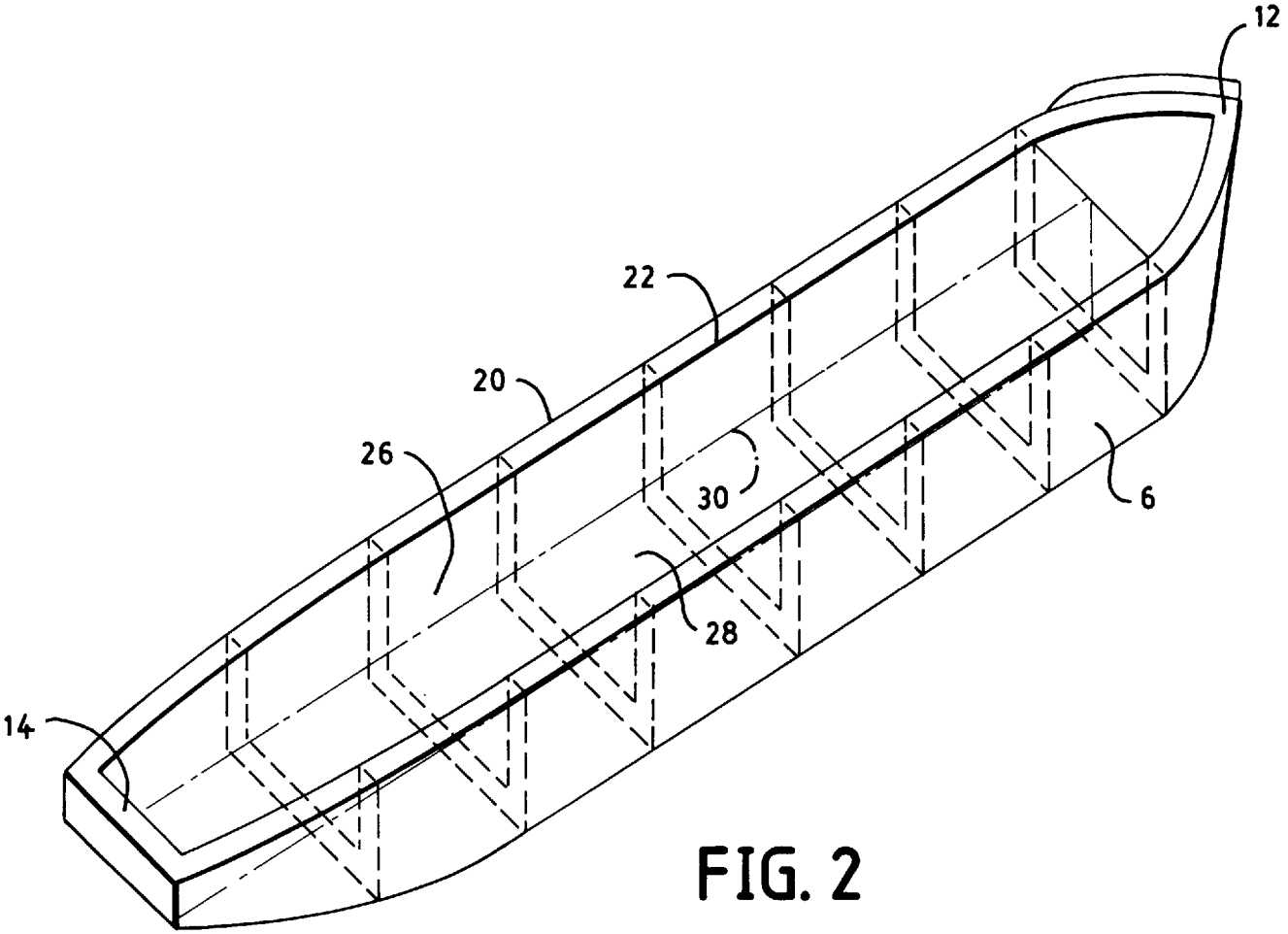
FIG. 2 is a perspective view of the hull of the warship of FIG. 1, without the ship's superstructure
Figure 3:
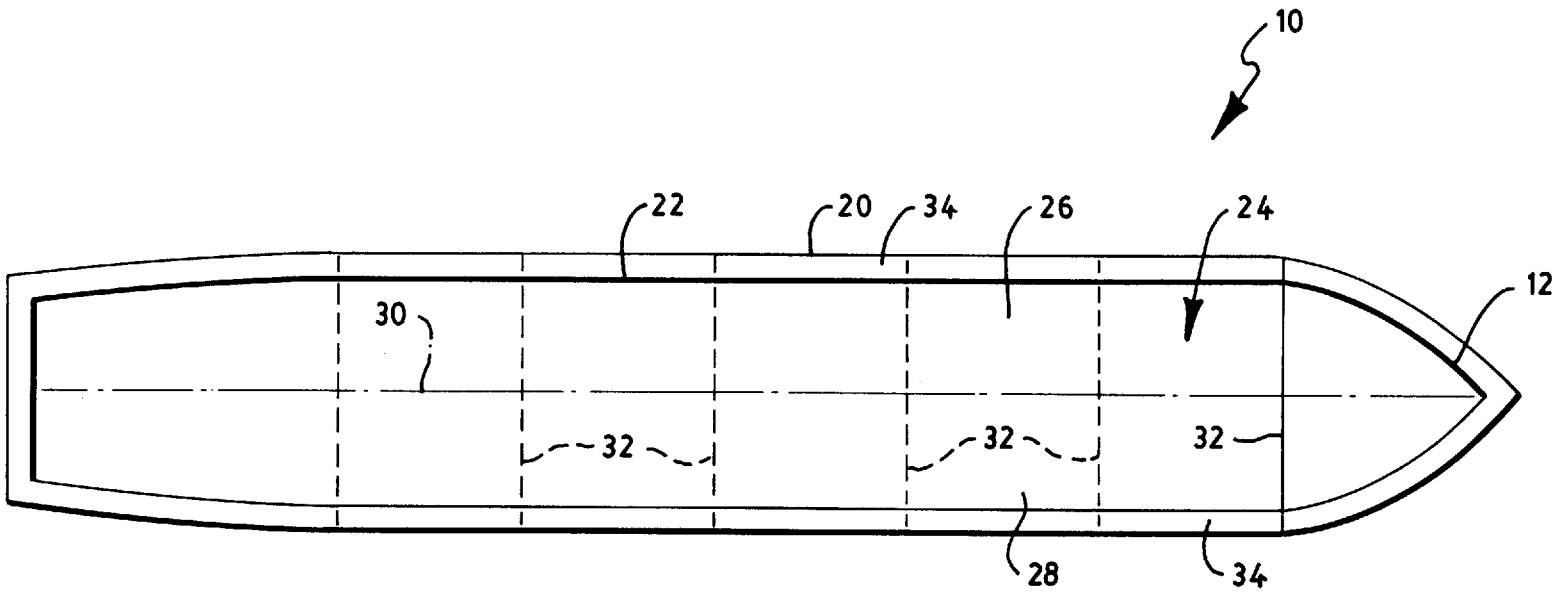
FIG. 3 is a top view of the hull of FIG. 2.
Figure 4:
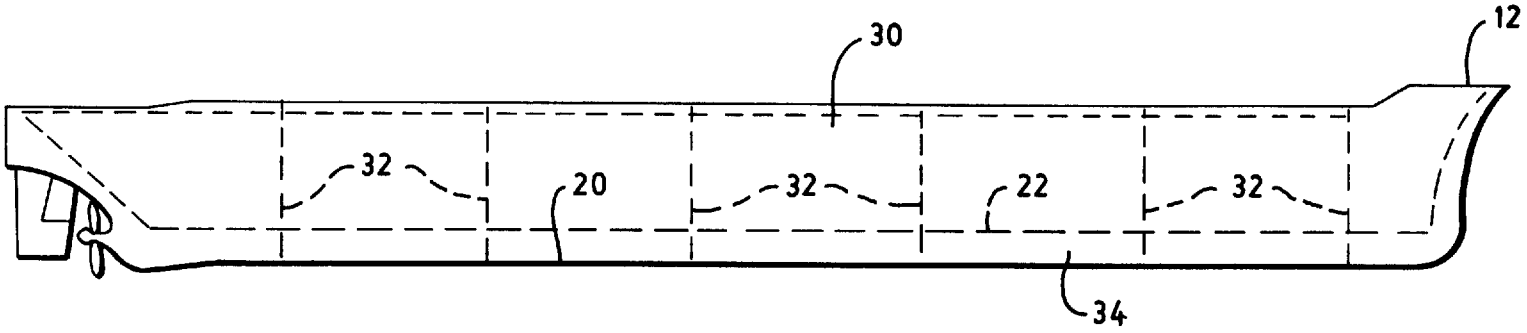
FIG. 4 is a side view of the vessel of FIG. 2.

Referring to FIGS. 2–4, double hull 6 includes a bow 12, a stern 14, an exterior hull, 20 and an interior hull 22. The interior section 24 which is generally formed by the interior surface of interior hull 22 can include a port section 26 and a starboard section 28 which are separated by longitudinal bulkhead 30. The longitudinal bulkhead 30 can include orifices (not shown) for personnel access and can extend the length of interior section 24. The port section 26 and starboard section 28 are divided along their lengths by transverse bulkheads 32 which are separated therefrom along the length of the section 24. The spaces 34 between the interior hull 22 and the exterior hull 20 are filled with the syntactic foam-macrosphere composition utilized in the present invention.

Figure 8:
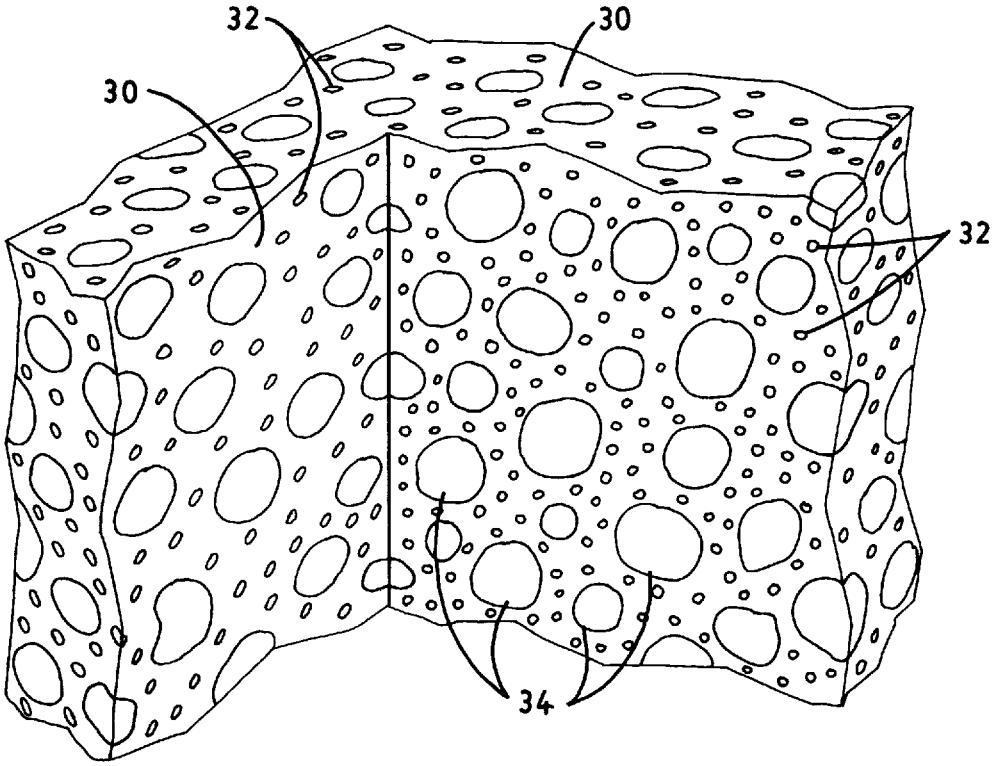
FIG. 8 is a cutaway view of the modified syntactic foam utilized in the present invention.

The double hull shown in FIG. 2–4 is shown generally as having a plurality of compartments 26 separated by bulkhead 30. This construction is desirable since it provides increased strength to the hull structure. The modified syntactic foam which is positioned between the interior hull 22 and exterior hull 20 is shown in FIG. 8. The syntactic foam portion comprises a hardened resin 30 containing microspheres 32 and macrospheres 34 of varying sizes. The macrospheres 34 are hollow spheres which are distributed throughout the bulk matrix of resin 30. The density of the syntactic foam comprising the hardened resin 30 and the microspheres 32 ranges between about 30 and about 40 pounds per cubic feet, preferably between about 32 and about 38 pounds per cubic feet. When the macrospheres 34 are added to the syntactic foam in the proportions set forth above, the resultant composition comprising the hardened resin 30, the microspheres 32 and macrospheres 34 has a density between about 14 and about 40 pounds per cubic feet, preferably between about 16 and about 24 pounds per cubic feet.

Figure 6:
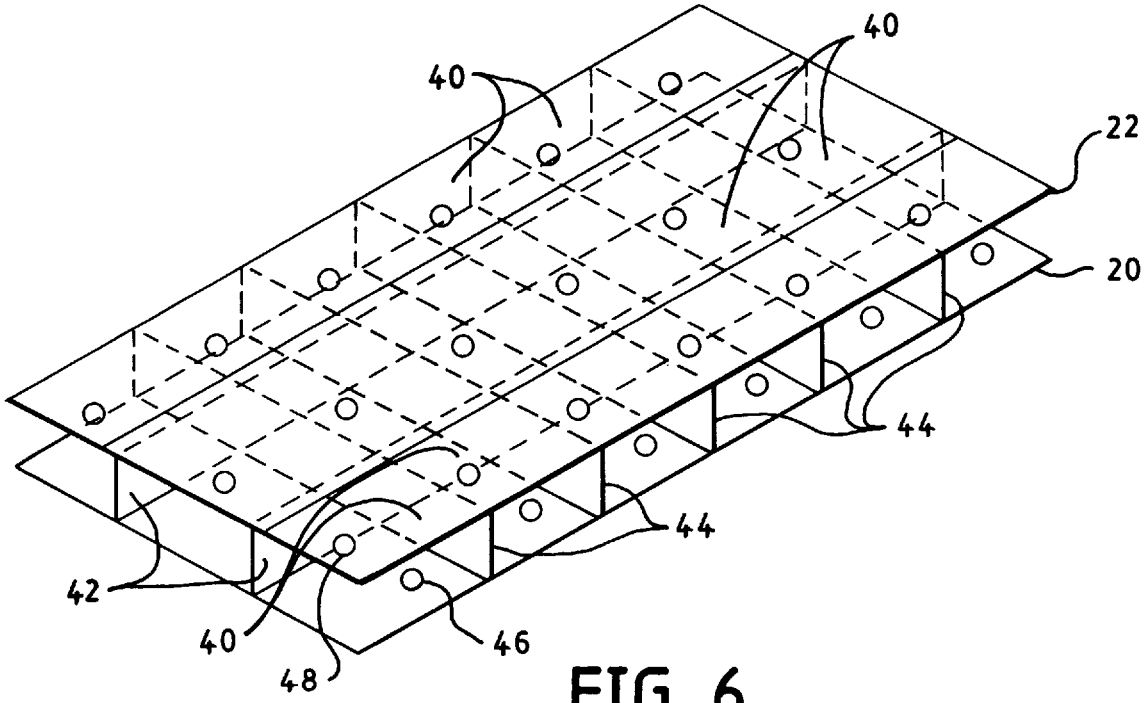
FIG. 6 is perspective view of double hull construction of this invention.

The modified syntactic foam in FIG. 8 is introduced into the spaces desired such as the space between interior hull 22 and the exterior hull 20. As shown in FIG. 6 the space between the interior hull 22 and the exterior hull 20 can be subdivided into subvolumes 40 by means of longitudinal bulkheads 42 and transverse bulkheads 44. Each subvolume 40 is provided with an inlet orifice 46 and an outlet orifice 48 which permit the introduction of the modified syntactic foam described above into each subvolume. Typically, the macrospheres are introduced through inlet 46 until the desired proportion of the subvolume 40 contains the macrospheres. Thereafter, the mixture of the hardenable fluid resin and the microspheres is pumped into the subvolume through the inlet 46 until excess resin appears at outlet 48. Thereafter, pumping of the resin and the microspheres into the subvolume 40 is stopped. After all of the subvolumes 40 have been filled with the syntactic foam utilized in the present invention, the resin portion of the syntactic foam is allowed to cure the form a thermoset resin, as described above.

Figure 5:
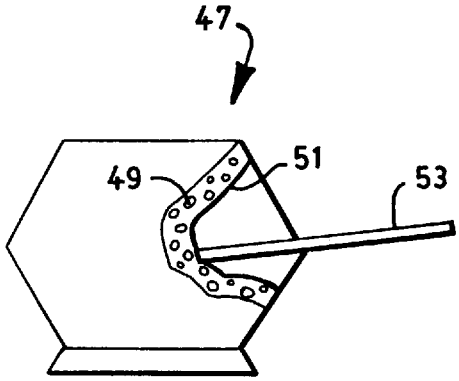
FIG. 5 is a cutaway view of a gun turret of the ship of FIG. 1.

The modified syntactic foam also can be introduced into volumes of the ship which require impact force protection other than the hull, as illustrated in FIG. 5. A gun turret 47 is formed of an outer wall 49 and an inner wall 51 to house a gun 53. The space between the walls 49 and 51 is filled with the modified syntactic foam containing macrospheres as described above.

Figure 7:
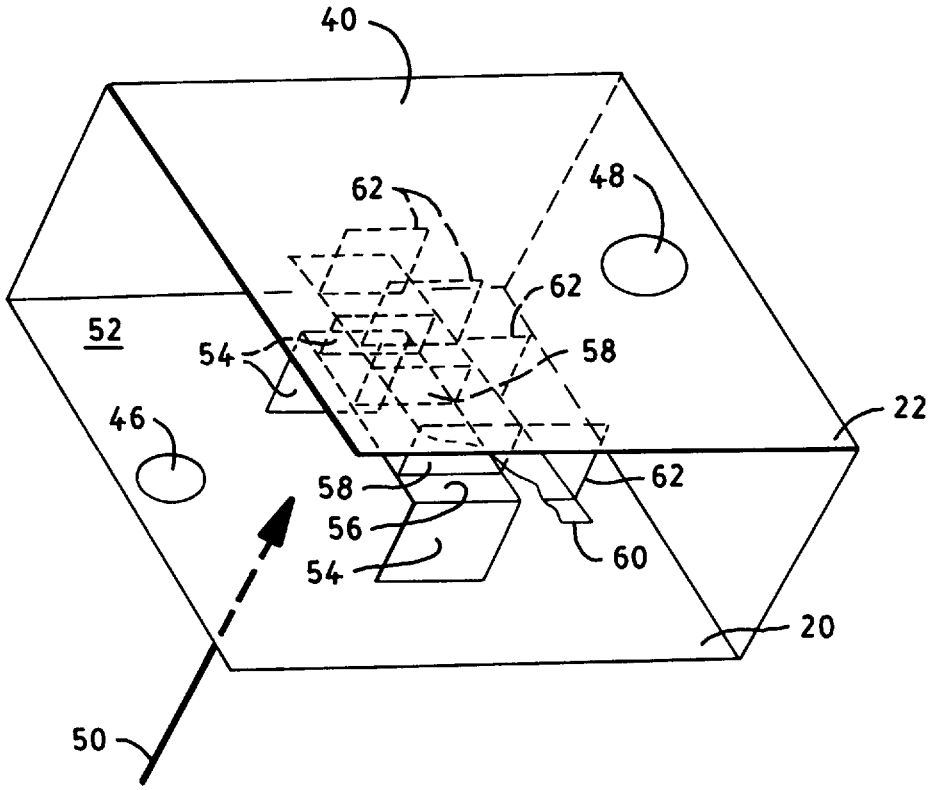
FIG. 7 is perspective view illustrating an alternative embodiment of this invention.

An alternative embodiment of this invention is shown in FIG. 7 wherein the subvolume 40 having an inlet 46 and an outlet 48 also includes mechanical means for dissipating impact forces to one an exterior surface such as exterior hull 20 as represented by arrow 50. The hollow space 52 within the subvolume 40 is filled with the syntactic foam- macrosphere composition described above. The force on exterior hull 20 is transmitted by vertical plates 54 which support horizontal plate 56. This force, in turn, is transmitted to the three vertical plates 58, then to horizontal plate 60, then to the four vertical plates 62 and lastly to inner hull 22. The plate system shown in FIG. 7 dissipates the initial force 50 so that any fmal force resulting from force 50 onto inner hull 22 is divided among the four vertical plates 62 rather than being concentrated within a small area of hull 22. Thus, the system of plate shown in FIG. 7 supplements the force dissipation function of the syntactic foam- macrosphere composition described above. In addition, the plates 58 can be designed to purposely fail when subjected to excessive force 50 so that the force 50 is not undesirably concentrated on inner hull 22.

Figure 9A:
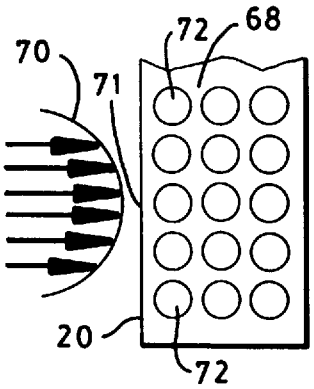
FIGS. 9*a,* 9*b* and 9*c* illustrate the force absorbing function of the modified syntactic foam utilized in the present invention.
Figure 9B:
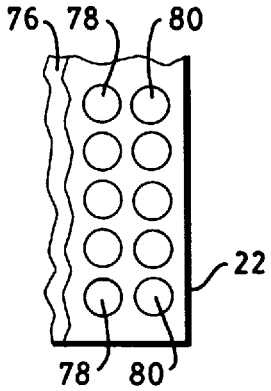
Figure 9C:
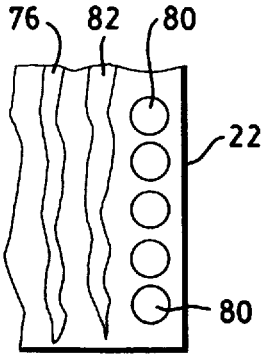

The failure mode of the syntactic foam-macrosphere composition described above, when utilized in the present invention is illustrated in the FIGS. 9*a,* 9*b* and 9*c*. The intact syntactic foam-macrosphere composition 68, prior to the application of a force 70 to an exterior surface such as exterior hull 20 is in FIG. 9*a*. As shown in FIG. 9*b,* the row of macrospheres 72 most proximate to impact force 70 is crushed to form crushed macrospheres 76 (FIG. 9*b*) while the remaining two rows of macrospheres 78 and 80 remain generally intact. The destruction of the row of macrospheres 72 serves to absorb a portion of the force 70 and to dissipate the force 70 away from the initial point of impact 71 on the exterior hull 20. As the impact force 70 proceed into the syntactic foam-macrosphere composition. The second row of macrospheres 78 is fractured to further dissipate and absorb the impact force 70. The destruction of macrospheres under the impact force serves to minimize or prevent the force applied to an inner surface such as inner hull 22, thereby substantially increasing the probability of maintaining the inner hull intact.

What is claimed is:

1. A ship which includes a plurality of volumes positioned within the ship, each of said volumes comprising:

an inner wall structure an outer wall structure spaced apart from said inner wall structure to provide a space between said inner wall structure and said outer wall structure, means for maintaining said inner wall structure spaced apart from said outer wall structure and, an energy absorbing composition positioned within said space comprising between about 10 and about 60 volume percent of a hardened resin containing hollow microspheres and between about 90 and about 40 volume percent macrospheres.

2. The ship of claim 1 wherein said hardened resin containing microspheres comprises between about 20 and about 40 volume percent of said composition and said hollow macrospheres comprises about 60 and about 80 volume percent of said composition.

3. The ship of any one of claims 1 or 2 wherein said resin is a phenolic resin.

4. The ship of any one of claims 1 or 2 wherein said resin is an epoxy resin.

5. The ship of any one of claims 1 or 2 wherein said resin is a polyurethane resin.

6. The ship of any one of claims 1 or 2 wherein said resin is a polyester resin.

7. The ship any one of claims 1 or 2 wherein said macrospheres have essentially the same size.

8. The ship of any one of claims 1 or 2 wherein said macrospheres have varying diameters between about 1/16 inch and 4 inches.

9. A ship which includes a plurality of volumes positioned within the ship, each of said volumes comprising:

an inner wall structure an outer wall structure spaced apart from said inner wall structure to provide a space between said inner wall structure and said outer wall structure, means for maintaining said inner wall structure spaced apart from said outer wall structure and, an energy absorbing composition positioned within said space comprising between about 10 and about 60 volume percent of a hardened resin containing hollow microspheres and between about 90 and about 40 volume percent macrospheres and means positioned within said energy absorbing composition for distributing an impact force on said outer wall structure throughout said energy absorbing composition.

10. The ship of claim 9 wherein said hardened resin containing microspheres comprises between about 20 and about 40 volume percent of said composition and said hollow macrospheres comprises about 60 and about 80 volume percent of said composition.

11. The ship of any one of claims 9 or 10 wherein said resin is a phenolic resin.

12. The ship of any one of claims 9 or 10 wherein said resin is a epoxy resin.

13. The ship of any one of claims 9 or 10 wherein said resin is a polyurethane resin.

14. The ship of any one of claims 9 or 10 wherein said resin is a polyester resin.

15. The ship any one of claims 9 or 10 wherein said macrospheres have essentially the same size.

16. The ship of any one of claims 9 or 10 wherein said macrospheres have varying diameters between about 1/16 inch and 4 inches.

17. The ship of any one of claims 1, 2, 9 or 10 wherein one of said volumes comprises a space between said inner wall structure comprising an inner hull and said outer wall structure comprising an outer hull.

* * * * *